US009739536B2

(12) United States Patent
Erben et al.

(10) Patent No.: US 9,739,536 B2
(45) Date of Patent: Aug. 22, 2017

(54) METHOD FOR COOLING A SOLID AND SYSTEM FOR CARRYING OUT THE METHOD

(71) Applicant: THYSSENKRUPP INDUSTRIAL SOLUTIONS AG, Essen (DE)

(72) Inventors: Axel Erben, Dortmund (DE); Matthias Pieper, Unna (DE); Siegfried Ruzicka, Rodingersdorf (AT)

(73) Assignee: THYSSENKRUPP INDUSTRIAL SOLUTIONS AG, Essen (DE)

( * ) Notice: Subject to any disclaimer, the term of this patent is extended or adjusted under 35 U.S.C. 154(b) by 247 days.

(21) Appl. No.: 14/428,730

(22) PCT Filed: Sep. 11, 2013

(86) PCT No.: PCT/EP2013/068815
§ 371 (c)(1),
(2) Date: Mar. 17, 2015

(87) PCT Pub. No.: WO2014/044584
PCT Pub. Date: Mar. 27, 2014

(65) Prior Publication Data

US 2015/0247676 A1 Sep. 3, 2015

(30) Foreign Application Priority Data

Sep. 18, 2012 (DE) ..... 10 2012 108 777

(51) Int. Cl.
*F28C 3/12* (2006.01)

(52) U.S. Cl.
CPC ..... *F28C 3/12* (2013.01)

(58) Field of Classification Search
CPC ..... F28C 3/10; F28C 3/12
See application file for complete search history.

(56) References Cited

U.S. PATENT DOCUMENTS

2007/0175061 A1* 8/2007 Patka, Sr. ..... F26B 21/06 34/265
2012/0196239 A1* 8/2012 Hamel ..... C10J 3/52 432/9

FOREIGN PATENT DOCUMENTS

DE 2140508 A 2/1972
DE 3537595 C 4/1987
(Continued)

OTHER PUBLICATIONS

German Language International Search Report for International patent application No. PCT/EP2013/068815; mailing date Dec. 6, 2013.

(Continued)

*Primary Examiner* — Emmanuel Duke
(74) *Attorney, Agent, or Firm* — thyssenkrupp North America, Inc.

(57) ABSTRACT

The present disclosure relates to a method and a device for cooling a solid, in particular a hygroscopic bulk material, in a more energy-efficient manner. For this purpose, an air flow is, if needed, cooled and/or dehumidified and/or subsequently heated in order to reduce the relative humidity of the air flow. The cooling air flow conditioned in this manner is then used in a contact device for cooling the solid, and a heated exhaust air flow is drawn from the contact device. According to the invention, a part of the exhaust air flow is mixed with the air flow in order to pre-heat the air flow and thus reduce the relative humidity of the air flow. In addition, a second part of the exhaust air flow can be mixed with feed air and used in a separate second contact device in order to pre-cool the solid.

15 Claims, 2 Drawing Sheets

(56) References Cited

FOREIGN PATENT DOCUMENTS

| | | | |
|---|---|---|---|
| DE | 19611950 | A | 10/1997 |
| DE | 102009036119 | A1 | 2/2011 |
| EP | 0798030 | B | 10/1997 |
| EP | 1070683 | B | 1/2001 |
| EP | 1933104 | A1 | 6/2008 |

OTHER PUBLICATIONS

English Translation of International Search Report for International patent application No. PCT/EP2013/068815; mailing date Dec. 6, 2013.
English Translation of Abstract for EP 1933104 (A1).
English Translation of Abstract for DE 102009036119 (A1).
English Language Abstract of DE2140508A.
English Language Abstract of EP0798030B and DE19611950A.
English Language Abstract of EP1070683B.
English Language Abstract of DE3537595.

* cited by examiner

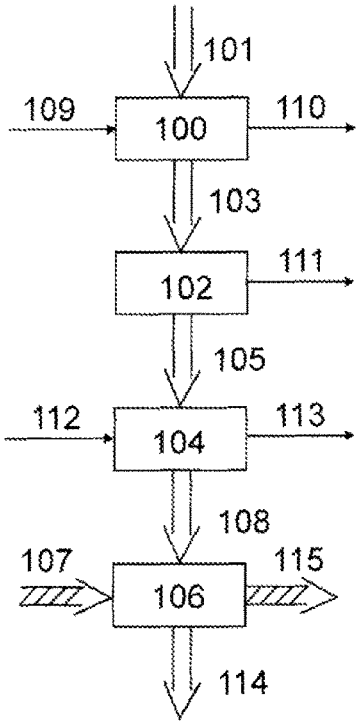
Fig. 1 - PRIOR ART
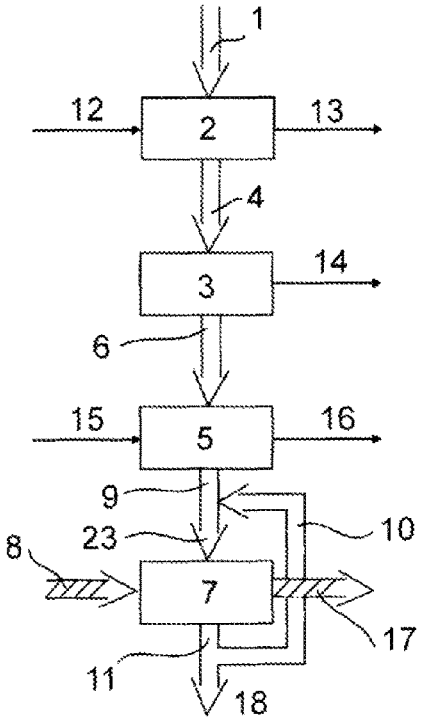
Fig. 2

METHOD FOR COOLING A SOLID AND SYSTEM FOR CARRYING OUT THE METHOD

CROSS REFERENCE TO RELATED APPLICATIONS

This application is a U.S. National Stage Entry of International Patent Application Serial Number PCT/EP2013/068815, filed Sep. 11, 2013, which claims priority to German patent application no. DE 102012108777.6 filed Sep. 18, 2012, the entire contents of both of which are incorporated herein by reference.

FIELD

The invention relates to a method for cooling a solid, in particular a hygroscopic bulk material, and to a system for carrying out the method.

BACKGROUND

Synthesis products of the chemical industry, which after forming for example by crystallizing, granulating, prilling, compacting, tabletting or pelleting and possible subsequent classification accumulate as bulk materials, are often still at a high temperature at the end of the production process. This heat has to be removed before they can be bagged and stored. Fluidized bed coolers and drum coolers are often used in order to cool the product, wherein air is used as the heat transfer medium. When cooling hygroscopic bulk materials, such as fertilizers and salts, it is necessary to dry the cooling air in order to prevent the product from absorbing moisture. Without drying the cooling air, there is the risk that the quality of the product will deteriorate. The hardness of the product drops with higher moisture content, whereby the shape previously imparted to the product can then be lost. In the most unfavorable case, bridge formation and clumping can occur.

Ambient air, which is used as cooling air, generally has a relative humidity which is too high for contact with hygroscopic materials. In order to achieve temperature and relative humidity values for the cooling air which are suitable for the cooling process, the cooling air passes through a conditioning process. There, the air is first cooled and the water contained therein is separated by condensation, absorption or adsorption. This lowers the dew point of the air. Then, the air is warmed back up to the point that the desired relative humidity for the cooling process is obtained. The air preconditioned in this manner is passed over the material to be cooled and removes heat therefrom without transferring humidity in the process. The provision of process cold and process heat for the conditioning process involves a large expenditure of energy.

Against the backdrop of rising energy costs, there exists the problem of proposing a method, and a system for carrying out the method, with lower energy consumption for cooling a solid, in particular a hygroscopic bulk material.

BRIEF DESCRIPTION OF THE DRAWINGS

The present disclosure is described in detail below with reference to the attached drawing figures, wherein:

FIG. 1 is a schematic flow chart of a prior art system for cooling a solid.

FIG. 2 is a schematic flow chart of an embodiment of a system of the present disclosure for cooling a solid.

DETAILED DESCRIPTION

Figure 3:
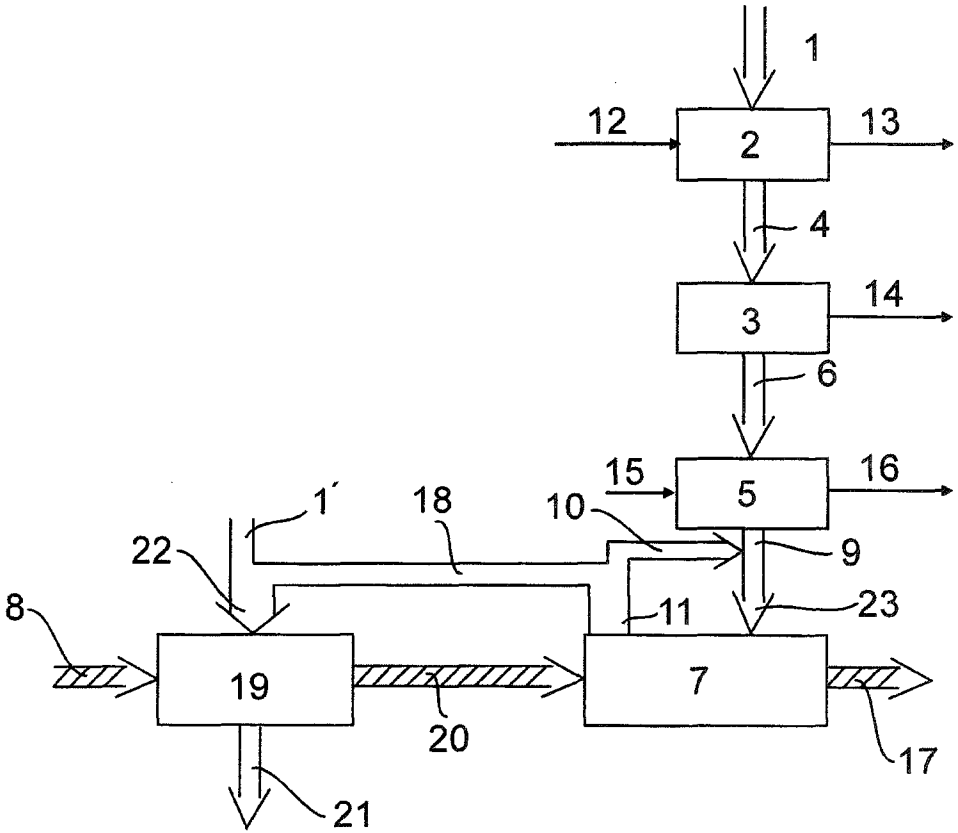
FIG. 3 is a schematic flow chart of an embodiment of a system for carrying out a two-state method for cooling a solid, as presently disclosed herein.

The invention is based on a method for cooling a solid, in particular a hygroscopic bulk material, in which an air flow is used in a contact device for cooling the solid, wherein a heated exhaust air flow is drawn from the contact device. According to the invention, a part of the exhaust air flow is mixed with the air flow in order to preheat the latter. This recycling contributes a substantial portion of the energy to be supplied for setting the required relative humidity.

In one particularly preferred embodiment, the air flow is cooled and/or dehumidified and/or then heated to reduce its relative humidity. The air flow preconditioned in this manner is then supplied for admixing with the part of the exhaust air flow.

This reduces both the need for process heat for heating the cooled and/or dehumidified cooling air and the quantity of cooled and/or dehumidified fresh air. Since only a transport of heat—but no transport of material—takes place in the contact device, the recycling causes no increase in the absolute humidity of the cooling air. As a result of the lower requirement for both process heat and fresh air, the method according to the invention has a markedly lower energy consumption than the method which is currently common. In addition to the thus reduced operating costs, investment costs can also be saved by means of the construction of a smaller air conditioning system.

According to one preferred embodiment of the invention, the air flow is cooled by indirect heat exchange with a refrigerant to a temperature below the dew point and condensate is separated. This method has inter alia the advantage compared to separation by absorption that no material need be prepared and/or regenerated for absorption. It is also within the scope of the invention that the air flow is cooled to a temperature above the dew point.

Expediently, the air flow is heated by means of a heating device heated by means of a heat transfer medium, preferably steam. Heating steam is a widespread form of process heat. It is easy and safe to handle and has a high enthalpy of condensation. The condensate forming in the heating device by emission of heat can also be safely removed and reused.

After cooling and dehumidification, the air flow is to be heated to a cooling air temperature which is lower than the inlet temperature of the air flow, respectively the ambient temperature. Expediently, to cool the solid, use is made of a dehumidified air flow which is cooler than the ambient air and therefore has greater cooling potential.

Preferably, a fluidized bed cooler or a drum cooler is used as the contact device for cooling the solid.

In the method according to the invention, the relative humidity of the conditioned cooling air flow remains below a critical limit value at which water passes, by exchange of heat and material, into the solid to be cooled. This ensures that the properties of the product are not negatively influenced by humidity introduced with the cooling air.

The energy efficiency can be increased further in that the solid is cooled in at least two series-connected cooling stages. In that context, the solid is precooled in a first cooling stage by exchange of heat by contact with a mixture of fresh air and a part of the heated exhaust air flow drawn from a second cooling stage, and is further cooled in the second cooling stage to the desired final temperature by exchange of heat by contact with preconditioned cooling air. Further, another part of the exhaust air flow from the second cooling stage for conditioning the cooling air is admixed to the air flow in order to preheat the latter. The low relative humidity of the exhaust air flow drawn from the second cooling stage leaves sufficient capacity for taking up the humidity from the fresh air flow so that the critical limit value of the relative humidity in the first cooling stage is not exceeded. In addition, the temperature range in the first cooling stage is generally higher than in the second cooling stage, such that the critical limit value of the relative humidity in the first cooling stage is reached only for a higher absolute humidity. Consequently, a greater quantity of humidity in the air flow can be tolerated in this case. It is expedient to feed the entire exhaust air flow from the second cooling stage, which is not used for preheating the cooled and dehumidified intake air, to the first product cooling stage.

In one preferred embodiment of the method according to the invention, the quantity of fresh air supplied to the product-side first cooling stage corresponds to the quantity of the exhaust air partial flow which is admixed to the air flow for conditioning the cooling air of the second cooling stage. Thereby, the same size of air flow acts on both contact devices.

The invention also relates to a system suitable for carrying out the method as described. This system comprises a contact device for cooling a solid by exchange of heat with preconditioned cooling air. According to the invention, there is provided a device for recycling a partial flow of the cooling air which is drawn from the contact device and which is heated by exchange of heat with the solid.

In one preferred embodiment, the system further has a device for cooling and/or dehumidifying the air flow and/or a device for heating the air flow.

A further embodiment of the invention relates to a system suitable for carrying out a two-stage cooling method, with a first contact device for precooling, by exchange of heat by contact with air, a solid, and with a second contact device for cooling, by exchange of heat by contact with preconditioned air, a solid which has been precooled in the first contact device. According to the invention, there is provided a device for recycling a partial flow of the cooling air which is drawn from the second contact device and which is heated in the exchange of heat with the solid and for admixing it to the air flow. The system further comprises a device for mixing a second partial flow of the heated cooling air drawn from the second contact device with intake air and supplying it to the first contact device.

The present disclosure is to be further clarified below with reference to an exemplary embodiment and the attached drawing figures.

FIG. 1 shows a system according to the prior art with a device 100 for cooling an air flow 101, a device 102 for dehumidifying the cooled air flow 103, a device 104 for heating the cooled and dehumidified air flow 105 and a contact device 106 for cooling a solid 107 through exchange of heat by contact with preconditioned cooling air 108. Process cold 109 acts on the air cooler 100. Well-suited for this is for example liquid ammonia which can evaporate in the air cooler 100 and extract heat from the intake air 101 by indirect exchange of heat. The waste heat is removed from the air cooler 100 with the flow 110. Part of the humidity 111 contained in the cooled air flow 103 is discharged in the device 102. In particular, the air flow 101 can be cooled in the air cooler 100 to a temperature below the dew point and condensate 111 can be separated in the device 102. The cooled and dehumidified air flow 105 is heated in the heating device 104 by indirect exchange of heat with a heat transfer medium 112. This heat transfer medium 112 is preferably steam which is discharged after giving off thermal energy as condensate 113. A heated exhaust flow 114 is drawn from the contact device 106. The cooled solid 115 is removed from the contact device 106 either continuously or stepwise, depending on the construction of the contact device.

FIG. 2 shows, schematically, a system according to the invention with a device—also termed an air cooler 2—for cooling an air flow 1, with a device 3 for dehumidifying the cooled air flow 4, with a device—also termed a heating device 5—for heating the cooled and dehumidified air flow 6, and with a contact device 7 for cooling a solid 8 through exchange of heat by contact with preconditioned cooling air 23. According to the invention, a partial flow 10 of the cooling air 11 drawn from the contact device 7 and heated in the exchange of heat with the solid 8 is recycled by means of a suitable device and is admixed with the cooled, dehumidified and reheated air flow 9 in order to preheat the latter. A refrigerant 12 acts on the air cooler 2 and waste heat 13 is removed therefrom. The condensate 14 produced by dehumidifying the cooled air flow 4 is separated in the device 3. The heating device 5 is supplied with heat by means of a heat transfer medium 15 which may be heating steam. After the transfer of heat, the heat transfer medium 16 is drawn out of the heating device 5. The cooled solid 17 removed from the contact device 7 can be stored or bagged. The exhaust air flow 11 drawn from the contact device 7 splits into a recycled partial flow 10 and a further partial flow 18 which as before is discarded, unused, as waste.

The two-stage method represented in FIG. 3 differs from the method according to FIG. 2 in that an exhaust air partial flow 18, which is not recycled for preheating the cooled, dehumidified and reheated air flow 9, is mixed with a further fresh air flow 1' to give a second cooling air flow 22 and a further contact device 19 is supplied, in which the solid 8 is precooled. The precooled solid 20 is then supplied to the contact device 7 where it is cooled to the desired final temperature. The exhaust air 21 drawn from the contact device 19 is removed from the system. According to one preferred embodiment, the quantities of air 22 and 23 which are supplied to the product coolers 7 and 19 are of approximately equal size. Then, the exhaust air partial flow 10, which is drawn from the contact device 7 and is recycled for heating the cooled and dehumidified air flow 9, also corresponds to the quantity of fresh air 1' which is admixed to the second exhaust air partial flow 18.

It is also within the scope of the invention to alternatively admix the exhaust air partial flow 10 with the cooled and dehumidified air flow 6.

The effect of the method according to the invention is to be explained below with reference to an energy balance. The energy balance relates to a system for cooling low-density ammonium nitrate (LDAN), wherein ambient air (1) is cooled by evaporation of ammonia and, after dehumidification by separation of condensate, a dehumidified, cooled air flow (6) is conditioned with heating steam (15).

| Variable | Value | Unit |
|---|---|---|
| Enthalpy of vaporization of ammonia | 1250 | kJ/kg |
| Enthalpy of condensation of steam (3 bar, 144° C.) | 2350 | kJ/kg |
| Temperature of the fresh air (1, 1') in the conditioning system (2) and the contact device (19) | 30 | ° C. |
| Relative humidity of the fresh air (1, 1') in the conditioning system (2) and the contact device (19) | 70 | % |
| Temperature of the exhaust air (11) from the contact device (7) | 29 | ° C. |
| Temperature of the cooling air (9) in the contact device (7) | 16 | ° C. |
| Temperature increase by ventilator after conditioning system | 2 | ° C. |
| Temperature after admixing (23) the recycled flow (10) to the cooled, dehumidified air flow (9) | 14 | ° C. |
| Required relative humidity of the air upon entry into the contact device (7) | 55 | % |
| Resulting absolute humidity of the air upon entry into the contact device (7) | 6.2 | g/kg air |
| Resulting dew point of the air in the conditioning system (2, 3, 5) | 7 | ° C. |
| Enthalpy of the air (1.013 bar, 7° C., 6.2 g/kg) after cooling (4) | 23 | kJ/kg |
| Enthalpy of the air (1.013 bar, 14° C., 6.2 g/kg) after mixing (23) | 30 | kJ/kg |
| Enthalpy of the air (1.013 bar, 29° C., 6.2 g/kg) in the exhaust air (11) | 45 | kJ/kg |
| Enthalpy of the air (1.013 bar, 30° C., RH 70%) in the fresh air (1, 1') | 78 | kJ/kg |
| Reduction in fresh air (1) to the conditioning system (2, 3, 5) | 31.5 | % |
| Air requirement of the contact device (7) | 150 000 | kg/h |
| Saving on fresh air by recycling (10) | 47 250 | kg/h |
| Saving on cold power | 720 | kW |
| Saving on ammonia | 2080 | kg/h |
| Saving on heating power | 90 | kW |
| Saving on steam | 140 | kg/h |

The invention claimed is:

1. A method for cooling a solid, in particular a hygroscopic bulk material, comprising:

passing the solid through a contact device;

injecting a cooling airflow into the contact device to cool the solid within the contact device and generate a heated exhaust air flow;

splitting the heated exhaust air flow into a first recycled partial exhaust air flow and a second partial heated exhaust air flow; and mixing the first recycled partial exhaust air flow into the cooling air flow, to preheat the cooling air flow.

2. The method of claim 1, wherein the cooling airflow is at least one of cooled, dehumidified, or reheated prior to said mixing step.

3. The method of claim 1, further comprising:

prior to said mixing step, cooling the cooling airflow, by indirect heat exchange with a refrigerant, to a temperature below the dew point; and separating condensate from the cooled cooling airflow.

4. The method of claim 1, further comprising:

prior to said mixing step, cooling the cooling airflow, by indirect heat exchange with a refrigerant, to a temperature above the dew point.

5. The method of claim 1, further comprising:

prior to said mixing step, heating the cooling air flow in a heating device by a heat transfer medium.

6. The method of claim 1, wherein the contact device is one of a fluidized bed cooler or a drum cooler.

7. The method of claim 1, wherein the cooling air flow is a conditioned cooling air flow having a relative humidity that remains below a critical limit value at which water passes, by exchange of heat and material, into the solid to be cooled.

8. The method of claim 1, further comprising cooling the solid in at least a first cooling stage and a second cooling stage connected in series.

9. The method of claim 8, further comprising:

conveying the solid to the first cooling stage;

in the first cooling stage, precooling the solid by heat exchange whereby the solid is contacted with a mixture of fresh air and the second partial heated exhaust airflow that is drawn from the second cooling stage;

conveying the solid to the second cooling stage; and in the second cooling stage, further cooling the solid to a desired final temperature by heat exchange, whereby the solid is contacted with the cooling air flow, wherein the cooling airflow has been preconditioned.

10. The method of claim 9, wherein a quantity of fresh air supplied to the first cooling stage is substantially equal to a quantity of the first recycled partial exhaust air flow that is mixed into the cooling airflow.

11. A system for cooling a solid, in particular a hygroscopic bulk material, comprising:

a contact device configured to cool the solid by heat exchange, whereby the solid is contacted with preconditioned cooling air within said contact device; and an air recycling device in gaseous communication with said contact device and configured to recycle a partial flow of cooling air that is drawn from the contact device and has been heated in said contact device by exchange of heat with the solid.

12. The system of claim 11, further comprising:

a preconditioning device configured to at least one of cool or dehumidify the cooling air prior to the cooling air entering the contact device as preconditioned cooling air; and a heating device configured to heat the cooling air prior to the cooling air entering the contact device as preconditioned cooling air.

13. The system of claim 11, wherein said contact device comprises:

a first contact device configured to precool the solid by heat exchange, whereby the solid is contacted with air within said contact device;

a second contact device in communication with said first contact device and configured to cool the solid by heat exchange to a final desired temperature, whereby the solid that has been precooled in the first contact device can be contacted with the preconditioned cooling air.

14. The system of claim 13, wherein said air recycling device is in gaseous communication with said second contact device and configured to recycle a first partial flow of cooling air that is drawn from said second contact device and has been heated in said second contact device by exchange of heat with the solid.

15. The system of claim 14, further comprising a mixing device in gaseous communication with said second contact device and configured to mix intake air with a second partial flow of the heated cooling air that is drawn from said second contact device, and supply the mixed cooling air to said first contact device to be used to precool the solid.

* * * * *